US009376235B2

(12) United States Patent
Goldburt

(10) Patent No.: US 9,376,235 B2
(45) **Date of Patent: *Jun. 28, 2016**

(54) CONTAINER FOR BEVERAGES

(75) Inventor: Tim Goldburt, Ardsley, NY (US)

(73) Assignee: Medea Inc., Pleasanton, CA (US)

( * ) Notice: Subject to any disclaimer, the term of this patent is extended or adjusted under 35 U.S.C. 154(b) by 1018 days.

This patent is subject to a terminal disclaimer.

(21) Appl. No.: 12/590,013

(22) Filed: Nov. 2, 2009

(65) Prior Publication Data

US 2011/0100853 A1 May 5, 2011

(51) Int. Cl.
*B65D 85/00* (2006.01)
*B65D 23/14* (2006.01)

(52) U.S. Cl.
CPC ..... *B65D 23/14* (2013.01); *B65D 2203/12* (2013.01)

(58) Field of Classification Search
CPC .. B65D 2203/00; B65D 5/4229; B65D 75/54; B65D 23/14; B65D 2203/12; G09F 3/04; G09F 1/04
USPC ..... 206/459.5, 459.1; 40/310, 124.02, 40/124.06, 124.07, 306, 665, 447, 448, 40/627, 626, 5, 455, 446, 902, 463
See application file for complete search history.

(56) References Cited

U.S. PATENT DOCUMENTS

| | | | | |
|---|---|---|---|---|
| 97,669 | A | 12/1869 | Millen | |
| D20,656 | S | 3/1891 | Dawes | |
| D23,100 | S | 3/1894 | Fay et al. | |
| 716,793 | A | 12/1902 | Vogeler | |
| 823,008 | A | 6/1906 | Vendig | |
| 1,262,788 | A | 4/1918 | Heidenreich | |
| 1,554,191 | A | 9/1925 | Alexander | |
| 1,653,608 | A | 3/1927 | Allen | |
| 1,686,354 | A | 3/1927 | Wallace | |
| 1,769,147 | A | 12/1927 | Benjamin | |
| D79,958 | S | 11/1929 | De Wagner | |
| 1,770,093 | A | 7/1930 | West | |
| D85,487 | S | 7/1931 | Meyer | |
| 1,856,550 | A | 5/1932 | Guenard | |
| 3,864,976 | A * | 2/1975 | Parker | 374/161 |
| 3,965,590 | A | 6/1976 | Algaze | |
| 3,996,879 | A | 12/1976 | Walton | |
| 4,607,756 | A | 8/1986 | Courtman | |
| D285,903 | S | 9/1986 | Courtman | |

(Continued)

FOREIGN PATENT DOCUMENTS

| | | |
|---|---|---|
| JP | 07-027624 | 1/1995 |
| WO | WO 03/099039 | 12/2003 |
| WO | WO 2010/138107 | 12/2010 |

OTHER PUBLICATIONS

Tech-Recipes, http://www.tech-recipes.com/rx/2484/iphone_change_the_auto_lock_delay/, Jun. 29, 2007.

(Continued)

*Primary Examiner* — Jacob K Ackun
*Assistant Examiner* — Jenine Pagan
(74) *Attorney, Agent, or Firm* — Lowenstein Sandler LLP

(57) ABSTRACT

A container for beverages has a hollow container body, an electronic device attached to the hollow container body and provided with a display for displaying a running light message, a microprocessor operative for generating a running light message on the display, and a control unit for controlling the microprocessor for carrying out the generation of the running unit message on the display.

14 Claims, 3 Drawing Sheets

(56) References Cited

U.S. PATENT DOCUMENTS

| | | | | |
|---|---|---|---|---|
| 4,765,465 | A | 8/1988 | Yamada et al. | |
| 4,928,412 | A | 5/1990 | Nishiyama | |
| D314,308 | S | 2/1991 | Cogswell | |
| D317,123 | S | 5/1991 | Colani | |
| D318,224 | S | 7/1991 | Altobelli | |
| 5,125,866 | A | 6/1992 | Arad et al. | |
| 5,168,646 | A | 12/1992 | Dippong et al. | |
| 5,201,431 | A | 4/1993 | Berger et al. | |
| 5,211,699 | A | 5/1993 | Tipton | |
| 5,297,247 | A | 3/1994 | Kan | |
| 5,339,548 | A * | 8/1994 | Russell | 40/324 |
| 5,347,453 | A * | 9/1994 | Maestre | 705/2 |
| 5,379,916 | A * | 1/1995 | Martindale et al. | 222/1 |
| 5,553,735 | A | 9/1996 | Kimura | |
| 5,575,553 | A | 11/1996 | Tipton | |
| 5,678,925 | A * | 10/1997 | Garmaise et al. | 374/157 |
| 5,774,876 | A | 6/1998 | Woolley et al. | |
| 5,823,346 | A | 10/1998 | Weiner | |
| 5,863,752 | A * | 1/1999 | Court et al. | 435/34 |
| 5,884,421 | A | 3/1999 | Key | |
| 5,992,678 | A | 11/1999 | Willey | |
| 6,037,872 | A | 3/2000 | Dunnum | |
| 6,062,380 | A | 5/2000 | Dorney | |
| 6,084,526 | A * | 7/2000 | Blotky et al. | 340/691.6 |
| 6,158,870 | A | 12/2000 | Ramirez | |
| D436,852 | S | 1/2001 | Chan | |
| 6,213,616 | B1 * | 4/2001 | Chien | 362/84 |
| 6,302,608 | B1 | 10/2001 | Holmes et al. | |
| 6,393,401 | B1 | 5/2002 | Loudermilk et al. | |
| D470,770 | S | 2/2003 | Machado et al. | |
| 6,527,402 | B1 | 3/2003 | Borri | |
| D473,469 | S | 4/2003 | Claessen | |
| 6,588,131 | B2 | 7/2003 | O'Connell, Jr. | |
| 6,588,593 | B2 * | 7/2003 | Woskoski | 206/459.1 |
| 6,747,918 | B2 * | 6/2004 | Hight et al. | 368/10 |
| 6,762,734 | B2 | 7/2004 | Blotky et al. | |
| 6,872,116 | B1 | 3/2005 | Dunnum et al. | |
| 6,923,549 | B2 | 8/2005 | Hoy | |
| 6,945,418 | B2 | 9/2005 | Guido et al. | |
| 7,000,343 | B1 | 2/2006 | Teichman | |
| D521,388 | S | 5/2006 | Andoh | |
| D521,389 | S | 5/2006 | Andoh | |
| D522,865 | S | 6/2006 | Andoh | |
| D523,346 | S | 6/2006 | Andoh | |
| 7,152,832 | B2 | 12/2006 | Wochnick | |
| 7,163,311 | B2 | 1/2007 | Kramer | |
| 7,300,171 | B2 | 11/2007 | Sutton | |
| D571,153 | S | 6/2008 | Lopez | |
| 7,383,650 | B2 | 6/2008 | Duesler | |
| D574,249 | S | 8/2008 | Seum et al. | |
| D575,583 | S | 8/2008 | Morgan | |
| 7,413,082 | B2 | 8/2008 | Adler et al. | |
| D596,037 | S | 7/2009 | Slubski | |
| 7,690,533 | B2 | 4/2010 | Stilley | |
| D617,200 | S | 6/2010 | Goldburt | |
| 7,824,051 | B2 | 11/2010 | Walter et al. | |
| 7,837,333 | B2 | 11/2010 | Chou et al. | |
| 7,934,845 | B2 | 5/2011 | Yang | |
| 7,954,970 | B2 | 6/2011 | Goldburt | |
| 8,056,273 | B2 | 11/2011 | Goldburt | |
| 8,123,033 | B2 | 2/2012 | Goldburt | |
| 8,232,981 | B2 | 7/2012 | Sandy | |
| 2002/0097195 | A1 * | 7/2002 | Frank | 345/5 |
| 2002/0104848 | A1 | 8/2002 | Burrows et al. | |
| 2002/0126150 | A1 | 9/2002 | Parry | |
| 2002/0190869 | A1 * | 12/2002 | Blotky et al. | 340/691.1 |
| 2003/0076672 | A1 | 4/2003 | Head | |
| 2003/0099158 | A1 * | 5/2003 | De la Huerga | 368/10 |
| 2003/0122730 | A1 * | 7/2003 | Frank et al. | 345/1.1 |
| 2003/0129283 | A1 | 7/2003 | Martinez Carballido | |
| 2003/0226298 | A1 | 12/2003 | Bjork | |
| 2004/0004829 | A1 | 1/2004 | Policappelli | |
| 2004/0026357 | A1 | 2/2004 | Beck et al. | |
| 2004/0118022 | A1 * | 6/2004 | Duesler | 40/324 |
| 2004/0140286 | A1 * | 7/2004 | Zoller | 215/379 |
| 2004/0148117 | A1 * | 7/2004 | Kirshenbaum et al. | 702/82 |
| 2004/0206828 | A1 | 10/2004 | Harris | |
| 2005/0024858 | A1 | 2/2005 | Johnson | |
| 2005/0036301 | A1 | 2/2005 | Haines | |
| 2005/0134461 | A1 | 6/2005 | Gelbman et al. | |
| 2005/0152392 | A1 | 7/2005 | Lim et al. | |
| 2005/0161558 | A1 | 7/2005 | Stahl et al. | |
| 2005/0193612 | A1 | 9/2005 | Lowry | |
| 2005/0205437 | A1 | 9/2005 | Huffman et al. | |
| 2005/0207141 | A1 | 9/2005 | Boesch et al. | |
| 2005/0229449 | A1 | 10/2005 | Shepley | |
| 2005/0270396 | A1 | 12/2005 | Miyashita et al. | |
| 2006/0087831 | A1 * | 4/2006 | Kramer | 362/101 |
| 2006/0118507 | A1 | 6/2006 | Feldman | |
| 2006/0139928 | A1 * | 6/2006 | Griffiths et al. | 362/276 |
| 2006/0202042 | A1 * | 9/2006 | Chu | 235/492 |
| 2006/0231109 | A1 | 10/2006 | Howell et al. | |
| 2007/0024465 | A1 | 2/2007 | Howell et al. | |
| 2007/0069883 | A1 | 3/2007 | Collier et al. | |
| 2007/0091123 | A1 | 4/2007 | Akashi | |
| 2007/0158293 | A1 | 7/2007 | Andreani | |
| 2007/0299778 | A1 | 12/2007 | Haveson et al. | |
| 2008/0023357 | A1 | 1/2008 | Whiteis | |
| 2008/0034628 | A1 | 2/2008 | Schnuckle | |
| 2008/0074625 | A1 | 3/2008 | Lai et al. | |
| 2008/0100469 | A1 * | 5/2008 | Goldburt | 340/693.9 |
| 2008/0128300 | A1 * | 6/2008 | Bahar et al. | 206/242 |
| 2008/0149589 | A1 | 6/2008 | Lach | |
| 2008/0264816 | A1 | 10/2008 | Yeh | |
| 2008/0296191 | A1 * | 12/2008 | Ransch | 206/459.1 |
| 2008/0314861 | A1 | 12/2008 | Goldburt | |
| 2008/0317906 | A1 | 12/2008 | Goldburt | |
| 2008/0319876 | A1 | 12/2008 | Goldburt | |
| 2009/0293328 | A1 | 12/2009 | Bull | |
| 2010/0101124 | A1 | 4/2010 | Sorensen | |
| 2010/0182518 | A1 * | 7/2010 | Kirmse et al. | 348/836 |
| 2010/0300913 | A1 * | 12/2010 | Goldburt | 206/459.1 |
| 2010/0300914 | A1 | 12/2010 | Goldburt et al. | |
| 2011/0100852 | A1 | 5/2011 | Goldburt | |
| 2011/0100853 | A1 | 5/2011 | Goldburt | |
| 2011/0122120 | A1 | 5/2011 | Feuilloley | |
| 2011/0155604 | A1 * | 6/2011 | Goldburt | 206/459.5 |
| 2011/0303579 | A1 | 12/2011 | Sanders | |
| 2012/0171963 | A1 | 7/2012 | Tsfaty | |
| 2012/0239470 | A1 | 9/2012 | Goldburt | |
| 2013/0319892 | A1 | 12/2013 | Goldburt | |
| 2014/0094126 | A1 | 4/2014 | Sandy | |

OTHER PUBLICATIONS

International Search Report from PCT/US2009/006751, mailed Aug. 17, 2010.

Written Opinion from PCT/US2009/006751, mailed Aug. 17, 2010.

International Preliminary Report on Patentability from PCT/US2009/006751, mailed Nov. 29, 2011.

* cited by examiner

CONTAINER FOR BEVERAGES

BACKGROUND OF THE INVENTION

The present invention relates generally to a container for beverages.

Containers for beverages are generally known. Also, the containers for beverages are known which are provided with electronic devices for producing some images.

It is believed that containers for beverages of this type can be further improved.

SUMMARY OF THE INVENTION

Accordingly, it is an object of the present invention to provide a container for beverages having an electronic device, which is a further improvement of the containers for beverages of this type.

In keeping with these objects and with others which will become apparent hereinafter, one feature of the present invention, resides, briefly stated, in a container for beverages having a hollow container body; and an electronic device attached to said hollow container body and provided with a display for displaying a running light message, microprocessing means operative for generating the running message on said display, and control means cooperating with said microprocessing means and controlling the generation the running light message on said display means.

Another feature of the present invention resides in that the microprocessing means is configured for generating on said display preliminarily stored electronic messages.

A further feature of the present invention resides in that the control means includes at least two control buttons for selecting the stored images in an increasing order and in a decreasing order.

A further feature of the present invention resides in that the microprocessing means is configured so as to generate on said display running messages composable by a user.

Another feature of the present invention resides in that the control means includes an entry button operating said microprocessor means so that said microprocessor means can display on said display means, letters, elements selected from the group consisting of elements selected from the group consisting of letters, numbers and signals thus enabling a user to compose a message, and also additional buttons operative for displaying of a display said elements with a corresponding order.

Another feature of the present invention resides in that the display means includes a plurality of illuminating elements including 25 vertical columns and 5 horizontal lines of said illuminating elements.

Another feature of the present invention resides in that the illuminating elements are elements selected from the group consisting of LEDs and OLEDs.

Another feature of the present invention resides in that the container has a container body provided with a partially circumferential recess, the electronic device being insertable in the recess.

Another feature of the present invention resides in that a band element is selected from the group consisting of a transparent band element and a translucent band element is fitted circumferentially over the electronic device so as to hold said electronic device in said recess.

Another feature of the present invention resides in that an intermediate element is located between the electronic device and the band element and provided with throughgoing openings in areas of said display means and control means.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
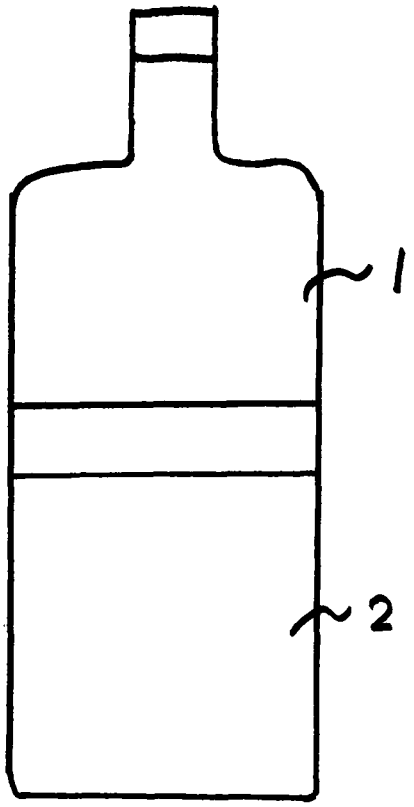
FIG. 1 is a side view showing a container for beverages with an electronic device in accordance with the present invention.
Figure 2:
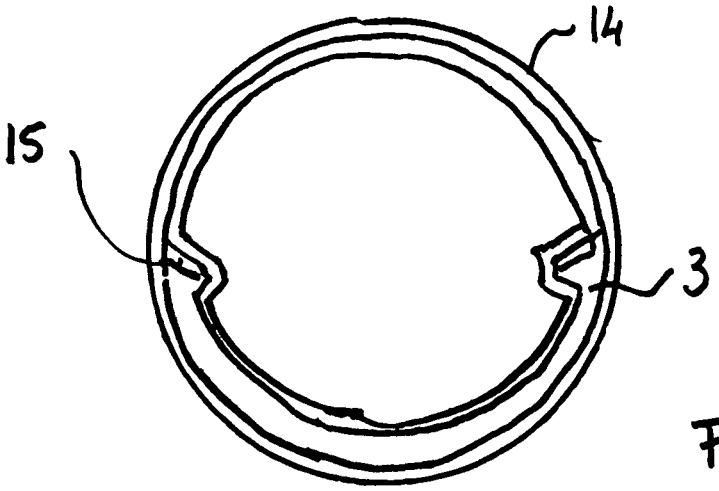
FIG. 2 is a view showing a cross-section of the container for beverages with the electronic device in accordance with the present invention.
Figure 3:
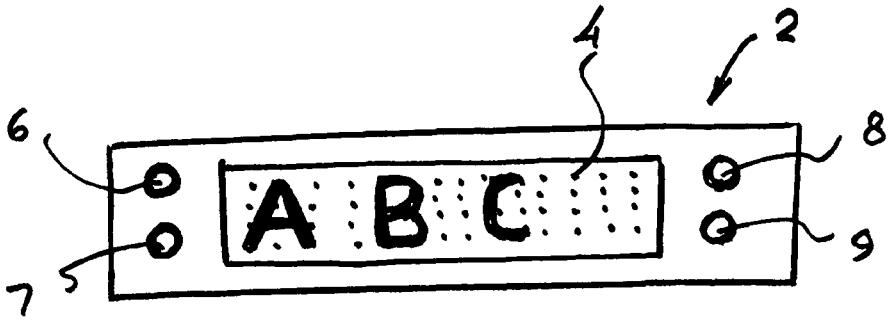
FIG. 3 is an enlarged view of a front surface of the electronic device of the inventive container for beverages.
Figure 4:
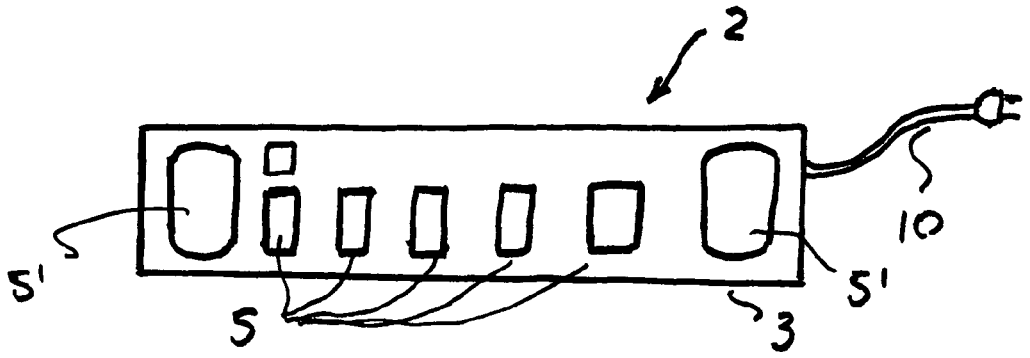
FIG. 4 is a view showing a back side of the electronic device.
Figure 5:
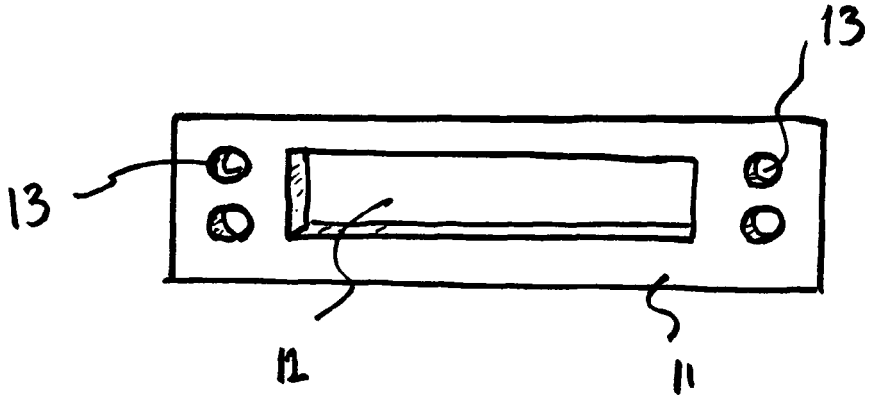
FIG. 5 shows an intermediate element between the electronic device and a bottom of a recess in the container.
Figure 6:
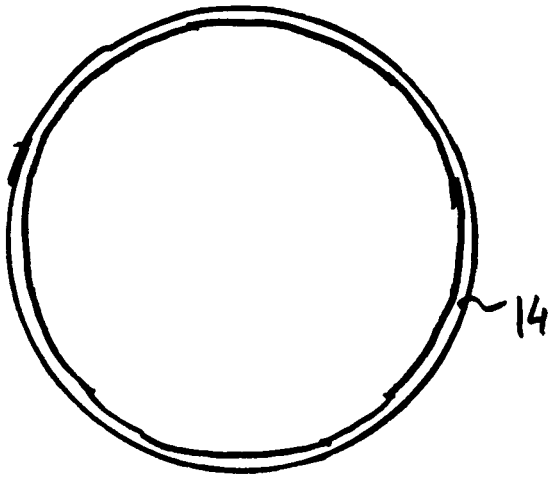
FIG. 6 is a view showing a transparent/translucent band which retains the electronic device on the container.

A container for beverages in accordance with the present invention has a hollow container body which is identified with reference numeral 1 and used for accommodating alcoholic or non-alcoholic beverages.

The container body 1 has a recess identified with reference numeral 2. An electronic device 3 is arranged in the recess 2.

The electronic device 3 has a display which is identified with reference numeral 4. The display 4 can include a plurality of LEDs or OLEDs, for example, for example five rows and twenty-five columns of these illuminating elements.

The electronic device 3 is further provided with a microprocessor 5. The microprocessor 5 is designed to provide several operational features. The microprocessor 4 has a memory in which individual elements such as letters, numbers, and symbols are stored, and in which also preliminary selected messages are stored as well. The microprocessor also has means for generating corresponding elements (letters, numbers, symbols) and the preliminarily selected messages on the display 4.

The electronic device further has control means which include an on/off button 6, an entry button 7, an up button 8, and a down button 9.

In accordance with the present invention, the microprocessing means or microprocessor 5 is designed so that it provides generation on the display 4 of running light messages. The electronic device 3 also has batteries 5'

The electronic device of the electronic container for beverages operates in the following manner.

When the on/off button is pressed by a user, a preliminarily provided message is displayed on the display 4 as a running light message. By pushing the button 8 or the button 9 the other preliminarily provided message can be selected correspondingly in an ascending order or in a descending order.

In accordance with the present invention, a user can compose a new running message to be displayed on the display 4. For this purpose the entry button 7 is pressed, and by pressing the buttons 8 or 9 letters, numbers, or symbols successively appear on the display 4. In order to memorize the corresponding letter, number or symbol, the entry button 7 is pressed again. By repeating this operation a corresponding number of times, a corresponding message can be composed, and then the on/off button is pressed to memorize this message. This running light message which is thusly selected by the user is then displayed on the display 4.

The letters to be selected can be letters of any alphabet, the numbers to be selected can be numbers of any calculation system, and the symbols can be any symbols such as a star, a flag, a geometric figure, a face, etc.

The electronic device can be provided with an electrical cable 10 to be plugged in a power source to operate the device.

A clock can be provided, so as to hold the device operational only for a certain short time, for example 3-5 min.

An intermediate element 11 can be provided between the electronic device 3 and a bottom of the recess 2 and composed for example of plastic. It can have a hole 12 for protruding display 4 and holes 13 for buttons 6, 7, 8, 9.

A transparent/translucent band 14 can be fitted around the electronic device 3 to hold it on the container.

Also double-sided adhesive inserts 15 can be provided to attach, projections of the electronic to walls of depressions.

It will be understood that each of the elements described above, or two or more together, may also find a useful application in other types of constructions differing from the type described above.

While the invention has been illustrated and described as embodied in a container for beverages, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A container for beverages, comprising a neck and a hollow container body; and an electronic device attached to said hollow container body, the electronic device comprising:

a memory;

a processor, coupled to the memory;

a plurality of inputs to control operation of the processor, wherein the plurality of inputs comprise:

a first control button that, when pressed while the processor is in a message composition mode that enables a running light message to be composed, causes the processor to scroll through a plurality of alphanumeric symbols in an increasing order;

a second control button that, when pressed while the processor is in the message composition mode, causes the processor to scroll through the plurality of alphanumeric symbols in a decreasing order;

an entry button that, when pressed while the processor is in the message composition mode, causes the processor to select a current one of the plurality of alphanumeric symbols, wherein the running light message is to be composed based on repeated use of the first control button, the second control button and the entry button while the processor is in the message composition mode to select a sequence of the plurality of alphanumeric symbols that together comprise the running light message; and an additional button that, when pressed while the processor is in a message selection mode that enables a stored message to be selected, turns on or off the electronic device and that, when pressed while the processor is in the message composition mode, causes the processor to store the composed running light message in the memory; and a display to display the running light message, the display comprising a plurality of rows and columns of illuminating elements.

2. A container as defined in claim 1, wherein the plurality of rows and columns of illuminating elements comprise 25 vertical columns and 5 horizontal rows of said illuminating elements.

3. A container as defined in claim 1, wherein each of said illuminating elements comprise at least one of a light emitting diode or an organic light emitting diode.

4. A container as defined in claim 1, further comprising:

a band selected from the group consisting of a transparent band element and a translucent band element, wherein the band is fitted circumferentially over said electronic device;

an intermediate element located between said electronic device and said band and provided with throughgoing openings in areas of said display and said inputs so that said display and said plurality of inputs protrude through said throughgoing openings of said intermediate element, wherein said band covers a circumference of said electronic device and also covers said intermediate element.

5. A container as defined in claim 1, further comprising means for holding said electronic device operational only for a predetermined time.

6. A container as defined in claim 1, further comprising:

an electrical cable to connect said electronic device to a power source.

7. A container body as defined in claim 1, further comprising an adhesive element located between a projection of said electronic device and a wall of a depression of said container body to attach said projection to said wall.

8. A container body as defined in claim 1, wherein:

the first control button, when pressed while the processor is in the message selection mode, causes the processor to scroll through and output to the display a next running light message of a plurality of running light messages stored in the memory in an increasing order; and the second control button, when pressed while the processor is in the message selection mode, causes the processor to scroll through and output to the display a next running light message of the plurality of running light messages stored in the memory in a decreasing order.

9. A container body as defined in claim 1, wherein the entry button is usable to switch the processor from the message selection mode to the message composition mode.

10. An electronic device, comprising:

a body configured for attachment to an object;

a memory;

a processor, coupled to the memory;

a plurality of inputs to control operation of the processor, wherein the plurality of inputs comprise:

a first control button that, when pressed while the processor is in a message composition mode that enables a running light message to be composed, causes the processor to scroll through a plurality of alphanumeric symbols in an increasing order;

a second control button that, when pressed while the processor is in the message composition mode, causes the processor to scroll through the plurality of alphanumeric symbols in a decreasing order;

an entry button that, when pressed while the processor is in the message composition mode, causes the processor to select a current one of the plurality of alphanumeric symbols, wherein the running light message is to be composed based on repeated use of the first control button, the second control button and the entry button while the processor is in the message composition mode to select a sequence of the plurality of alphanumeric symbols that together comprise the running light message; and an additional button that, when pressed while the processor is in a message selection mode that enables a stored message to be selected, turns on or off the electronic device and that, when pressed while the processor is in the message composition mode, causes the processor to store the composed running light message in the memory; and a display to display the running light message, the display comprising a plurality of rows and columns of illuminating elements.

11. The electronic device of claim 10, wherein the plurality of rows and columns of illuminating elements comprise 25 vertical columns and 5 horizontal rows of said illuminating elements.

12. The electronic device of claim 10, wherein each of said illuminating elements comprise at least one of a light emitting diode or an organic light emitting diode.

13. The electronic device of claim 10, wherein:

the first control button, when pressed while the processor is in the message selection mode, causes the processor to scroll through and output to the display a next running light message of a plurality of running light messages stored in the memory in an increasing order; and the second control button, when pressed while the processor is in the message selection mode, causes the processor to scroll through and output to the display a next running light message of the plurality of running light messages stored in the memory in a decreasing order.

14. The electronic device of claim 10, wherein the entry button is usable to switch the processor from the message selection mode to the message composition mode.

* * * * *